US006202554B1

(12) United States Patent
Kamoda

(10) Patent No.: US 6,202,554 B1
(45) Date of Patent: Mar. 20, 2001

(54) INTAGLIO PRINTING PRESS

(75) Inventor: Hiroyoshi Kamoda, Higashikatsushika-gun (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/376,369

(22) Filed: Aug. 18, 1999

(30) Foreign Application Priority Data

Aug. 21, 1998 (JP) ..... 10-235102
Jul. 22, 1999 (JP) ..... 11-207259

(51) Int. Cl.[7] ..... B41F 9/00
(52) U.S. Cl. ..... 101/153; 101/119; 101/150
(58) Field of Search ..... 101/153, 150, 101/151, 152, 154, 155, 119, 120

(56) References Cited

U.S. PATENT DOCUMENTS 4,056,056 * 11/1977 Giori ..... 101/152
4,103,615 * 8/1978 Cruz et al. ..... 101/120
4,441,423 * 4/1984 Germann ..... 101/175
4,516,596 * 5/1985 Giori ..... 101/152
4,604,951 * 8/1986 Ichikawa et al. ..... 101/153
5,062,359 * 11/1991 Giori ..... 101/152
5,146,850 * 9/1992 Funada et al. ..... 101/153
5,722,322 * 3/1998 Watanabe ..... 101/119 X
5,771,800 * 6/1998 Inamine et al. ..... 101/119

FOREIGN PATENT DOCUMENTS

242070 B2 9/1990 (JP) .

* cited by examiner

*Primary Examiner*—John S. Hilten
*Assistant Examiner*—Minh Chau

(57) ABSTRACT

An intaglio printing press comprises a plate cylinder having an intaglio plate mounted on a circumferential surface of the plate cylinder; an impression cylinder contacted with the plate cylinder; an ink collecting cylinder contacted with the plate cylinder and having a blanket mounted on a circumferential surface of the ink collecting cylinder; a chablon roller, intermediate rollers, an ink fountain roller, and an ink fountain, as a first ink supply means for supplying ordinary ink to the blanket of the ink collecting cylinder; a rubber roller, and a rotary screen, as a second ink supply means, contacted with the plate cylinder, for supplying special ink to the intaglio plate; and a wiping roller contacted with the plate cylinder. This intaglio printing press can use special ink with high efficiency.

9 Claims, 4 Drawing Sheets

INTAGLIO PRINTING PRESS

BACKGROUND OF THE INVENTION

1. Field of the Invention

The present invention relates to an intaglio printing press, and especially, one useful when applied to printing of banknotes or securities.

2. Description of the Related Art

FIG. 4 shows an example of a conventional intaglio printing press applied to printing of banknotes or securities (see, for example, Japanese Examined Patent Publication No. 2-42070). As shown in FIG. 4, a plate cylinder 112 having an intaglio plate mounted on an outer peripheral surface thereof is contacted with an impression cylinder 111. To the plate cylinder 112, an ink collecting cylinder 113 having rubber blankets mounted on an outer peripheral surface thereof is opposed in contact with the plate cylinder 112. To the ink collecting cylinder 113, three chablon rollers 114 are opposed in contact with the ink collecting cylinder 113 along a circumferential direction of the ink collecting cylinder 113. To each of these chablon rollers 114, an ink fountain or reservoir 117 filled with ordinary ink for printing of a main pattern is opposed in contact with the chablon roller via an ink fountain roller 116 and intermediate rollers 115. To the plate cylinder 112, a chablon roller 118 is also opposed in contact therewith. To this chablon roller 118, an ink fountain 121 filled with special ink, such as OVI (Optical Variable Ink), for printing of a pattern for forgery prevention is opposed in contact with the chablon roller 118 via an ink fountain roller 120 and intermediate rollers 119. Opposite the plate cylinder 112 and downstream from the ink collecting cylinder 113, a wiping roller 122 is disposed, in contact with the plate cylinder 112, for removing surplus ink adhering to the surface of the intaglio plate. The wiping roller 122 is immersed in a solvent stored in a wiping tank 123.

The foregoing conventional intaglio printing press is operated in the following manner:

When each ordinary ink is supplied from inside the ink fountain 117 to the chablon roller 114 via the ink fountain roller 116 and the intermediate rollers 115, each such ink is fed to the ink collecting cylinder 113, and then to the intaglio plate of the plate cylinder 112. On the other hand, when special ink is supplied from inside the ink fountain 121 to the chablon roller 118 via the ink fountain roller 120 and the intermediate rollers 119, the special ink is directly fed to the intaglio plate of the plate cylinder 112. The inks supplied to the intaglio plate of the plate cylinder 112 have their surplus amounts removed by the wiping roller 118. The remaining inks on the intaglio plate of the plate cylinder 112 are transferred to a sheet passed on to the impression cylinder 111 to perform printing.

Special ink, such as the aforementioned OVI, is expensive and has poor transfer characteristics. Thus, when it is supplied from the ink fountain 121 to the intaglio plate of the plate cylinder 112 via the ink fountain roller 120, the intermediate rollers 119, and the chablon roller 118, its loss increases, thereby deteriorating printing quality, and making the printing cost very high. Methods for minimizing the use of the intermediate rollers 119, etc. have been worked out, but have been unsuccessful in obtaining satisfactory results.

SUMMARY OF THE INVENTION

The present invention has been accomplished in view of the above-described problems. It is an object of the invention to provide an intaglio printing press which can use special ink with high efficiency.

To attain the above object, the present invention claims an intaglio printing press, comprising:

a plate cylinder having an intaglio plate mounted on a circumferential surface of the plate cylinder;

an impression cylinder contacted with said plate cylinder;

an ink collecting cylinder contacted with said plate cylinder and having a blanket mounted on a circumferential surface of the ink collecting cylinder;

a first ink supply means for supplying ink to said blanket of said ink collecting cylinder;

a second ink supply means, contacted with the plate cylinder, for supplying ink to said intaglio plate; and a wiping roller contacted with said plate cylinder, wherein said second ink supply means includes a rotary screen.

According to the intaglio printing press of the present invention, as described above, the second ink supply means having a rotary screen is in contact with the plate cylinder and adapted to supply ink to the intaglio plate. Even special ink, which is expensive and poor in transfer characteristics, can be supplied with high efficiency to the intaglio plate of the plate cylinder, if it is supplied by a unit with a rotary screen. Thus, even when special ink, expensive and poor in transfer characteristics, is used, deterioration of printing quality can be prevented, and an increase in the printing cost can be suppressed.

In the intaglio printing press according to the subject invention, the rotary screen is comprised of a rotatably support cylindrical hollow roller having a small hole pattern formed therein; an ink feed means for feeding ink to an inner peripheral surface of said hollow roller; and a squeegee, disposed inside said hollow roller, for delivering the ink, which has been fed by said ink feed means, through the small hole pattern of said hollow roller.

In the intaglio printing press, said second ink supply means includes a rotary screen, and a rubber roller contacted with said hollow roller of said rotary screen and said intaglio plate of said plate cylinder.

In the intaglio printing press, the rubber roller has a groove in an outer peripheral portion thereof in contact with an ink portion transferred to said intaglio plate of said plate cylinder.

In the intaglio printing press, support portions for constantly supporting said squeegee of said rotary screen via said hollow roller are located on said rubber roller.

In the intaglio printing press, the ink supplied by said second ink supply means comprises OVI (Optical Variable Ink).

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

Figure 1:
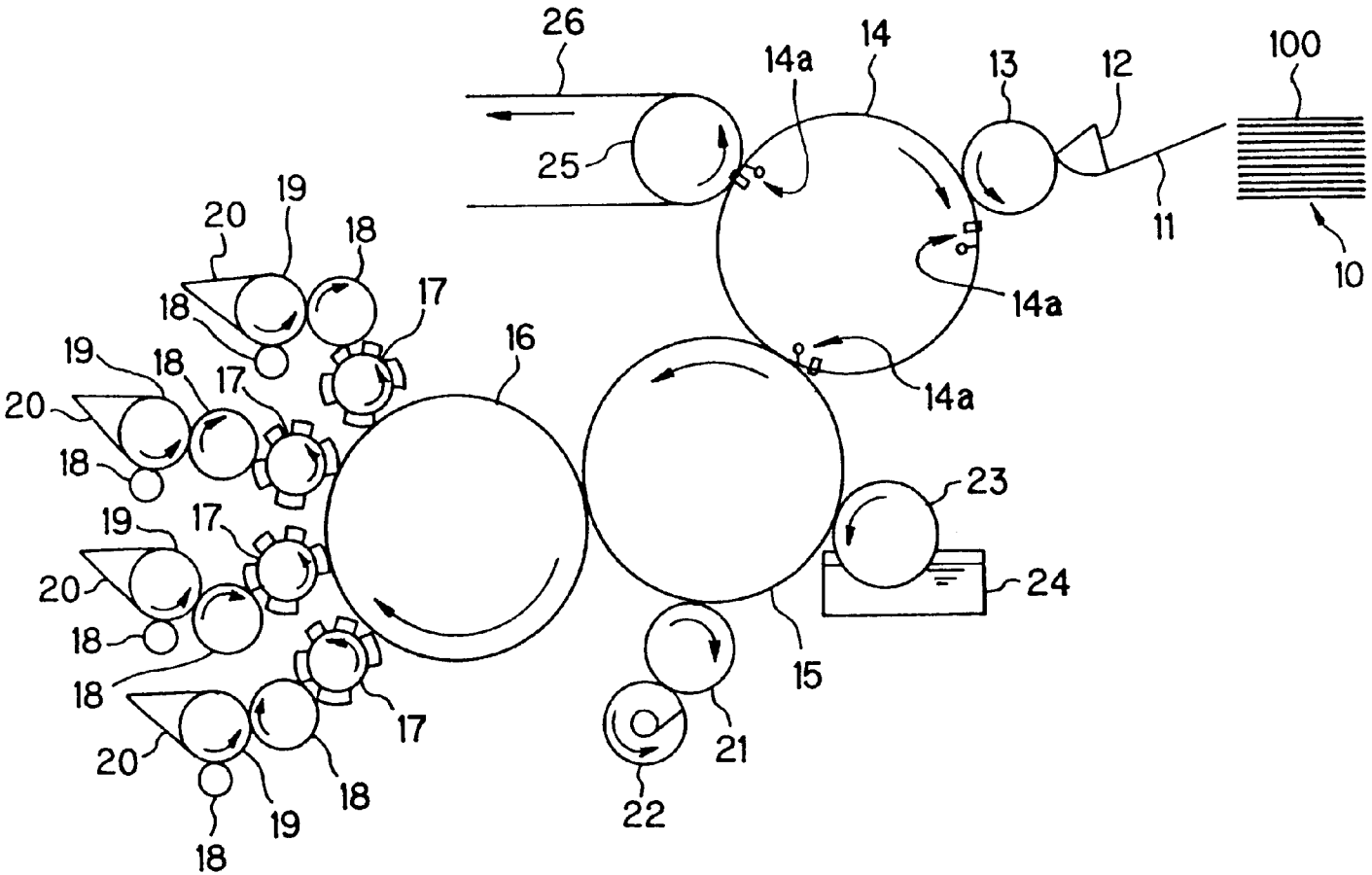
FIG. 1 is a schematic constitution drawing of an essential part of an embodiment of an intaglio printing press according to the present invention.
Figure 2:
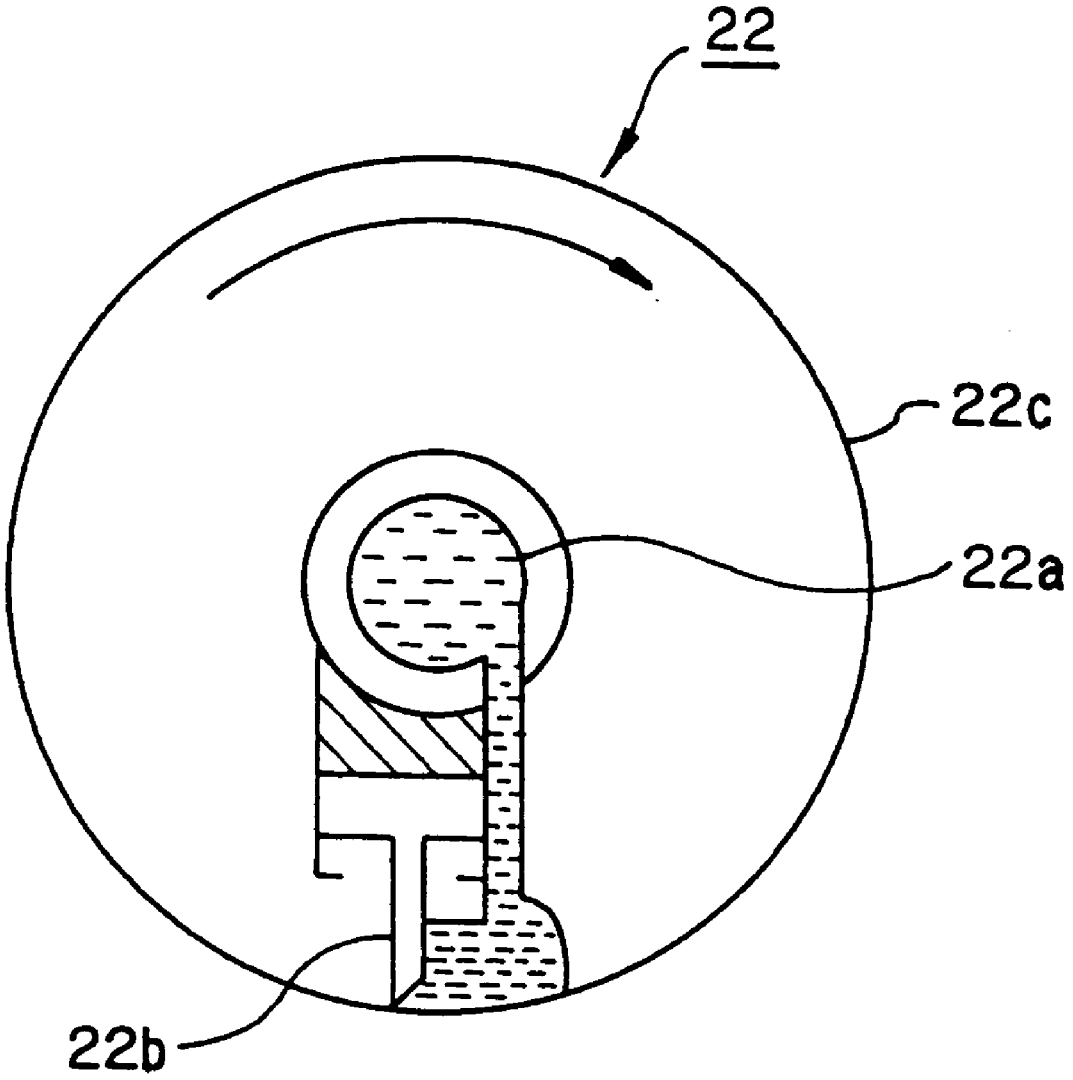
FIG. 2 is a schematic structural drawing of an interior of a rotary screen in FIG. 1.
Figure 3:
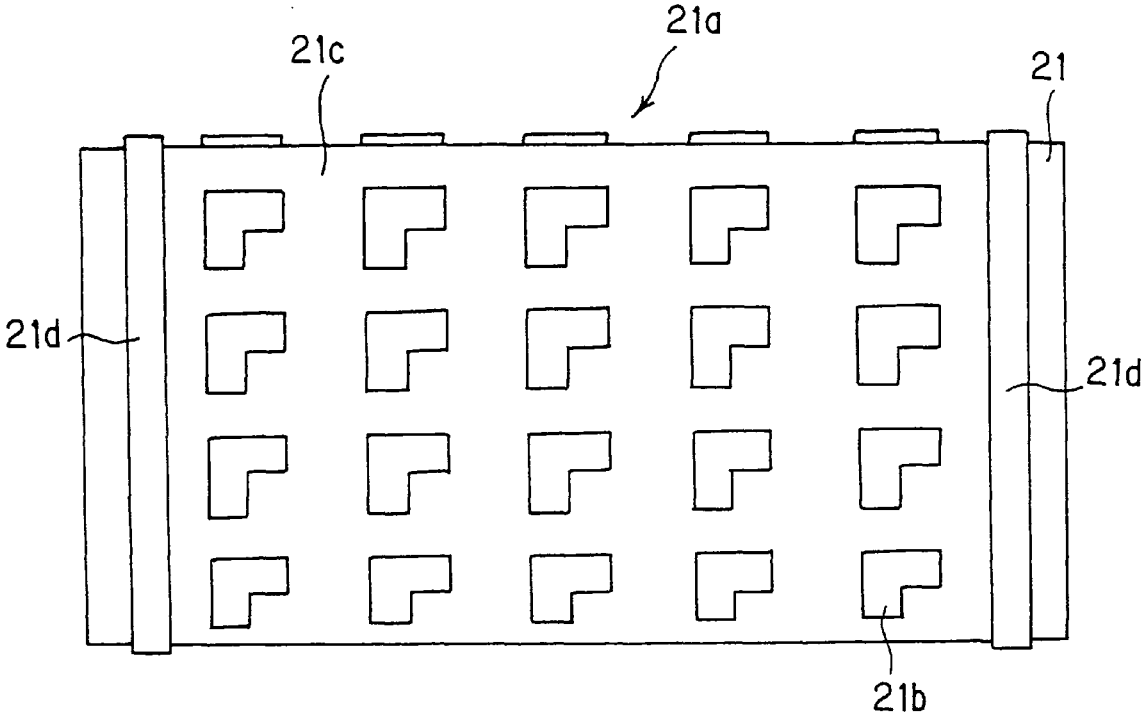
FIG. 3 is a plan view of a rubber roller in FIG. 1.
Figure 4:
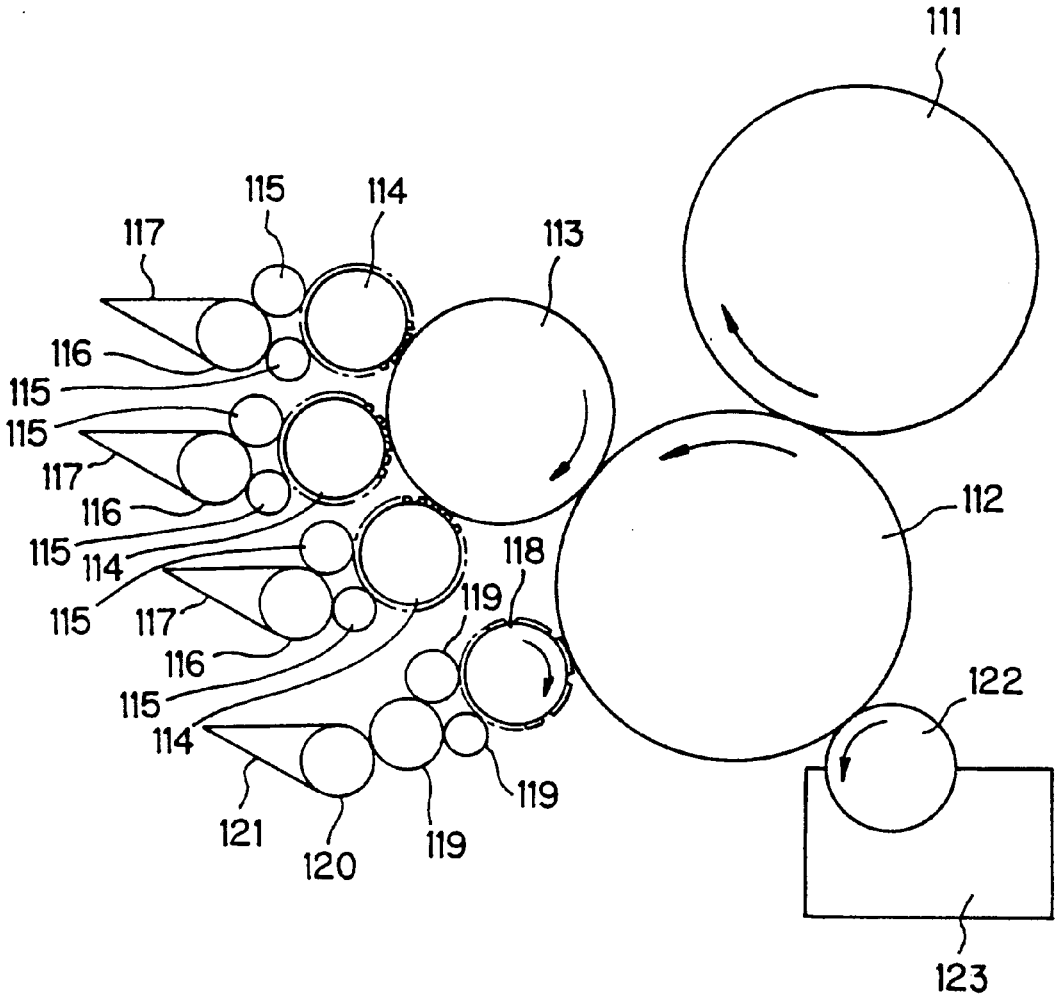
FIG. 4 Related Art
FIG. 4 is a schematic structural drawing of an essential part of an example of a conventional intaglio printing press.

An embodiment of an intaglio printing press according to the present invention will now be described with reference to FIGS. 1 to 3. FIG. 1 is a schematic constitution drawing of its essential part. FIG. 2 is a schematic structural drawing of an interior of a rotary screen in FIG. 1. FIG. 3 is a plan view of a rubber roller in FIG. 1. However, it should be understood that the invention is not restricted to this embodiment.

As shown in FIG. 1, a sheet feeder 10 stacked with sheets 100 communicates with a feedboard 11, which receives the sheets 100 fed one by one from an upper layer of a sheet stack by a sucker mechanism of the sheet feeder 10, and performs registration for printing. On the feedboard 11, a swing arm shaft pregripper 12 is disposed for gripping the sheet 100 on the feedboard 11 and making a swing motion. The swing arm shaft pregripper 12 communicates, via a transfer cylinder 13, with an impression cylinder 14, which has a plurality of (three in the present embodiment) grippers 14*a* disposed with equal spacing in a circumferential direction of the impression cylinder 14. The transfer cylinder 13 is provided with grippers similar to the grippers of the impression cylinder 14, so that the sheet 100 gripped from the swing arm shaft pregripper 12 can be passed on to the gripper of the impression cylinder 14.

To the impression cylinder 14, a plate cylinder 15, which can have a plurality of intaglio plates mounted along a circumferential direction of the plate cylinder 15, is opposed in contact with the impression cylinder 14. To the intaglio plates of the plate cylinder 15, an ink collecting cylinder 16, which can have a plurality of rubber blankets mounted along a circumferential direction of the ink collecting cylinder 16, is opposed in contact with the intaglio plates. To the ink collecting cylinder 16, a plurality of (four in the present embodiment) chablon rollers 17 are opposed in contact with, and circumferentially of, the ink collecting cylinder 16. To each of these chablon rollers 17, an ink fountain or reservoir 20 filled with ordinary ink for printing of a main pattern is opposed in contact with the chablon roller via an ink fountain roller 19 and intermediate rollers 18. The chablon rollers 17, intermediate rollers 18, ink fountain rollers 19, and ink fountains 20 constitute a first ink supply means according to the present embodiment.

To the plate cylinder 15, a rotary screen 22 filled inside with special ink such as OVI (Optical Variable Ink) for printing of a pattern for forgery prevention is opposed in contact with the plate cylinder 15 via a rubber roller 21. The rotary screen 22 has a structure as shown in FIG. 2. As shown in FIG. 2, the rotary screen 22 comprises a hollow roller 22*c*, which is a cylinder fabricated of a thin screen (a screen of stainless steel, nickel or the like) having an etching of a small hole pattern. The hollow roller 22*c* is rotatably mounted so that an ink fountain 22*a*, which is an ink feed means fixed to a frame, and a squeegee 22*b* can be positioned inside the hollow roller 22*c*. When the hollow roller 22*c* is rotated, special ink in the ink fountain 22*a* is delivered by the squeegee 22*b* through the small hole pattern of the hollow roller 22*c*. By this measure, the special ink can be supplied to the intaglio plate of the plate cylinder 15 via a printing pattern 21*b* (see FIG. 3) of a blanket 21*a* of the rubber roller 21. In other words, the rotary screen 22 can directly feed special ink in a constant amount, at the same time, in a predetermined pattern. The rubber roller 21 containing the printing 21*b*; and rotary screen 22 constitute a second ink supply means according to the present embodiment.

To prevent ordinary ink, transferred from the ink collecting cylinder 16 to the intaglio plate of the plate cylinder 15, from migrating to the rotary screen 22, the rubber roller 21 includes a groove or duct 21*c* formed in the blanket 21*a* on the outer periphery thereof which is in contact with an ordinary ink portion transferred to the intaglio plate of the plate cylinder 15, as shown in FIG. 3. When the groove or duct 21*c* of the blanket 21*a* of the rubber roller 21 is formed over the entire widthwise length of the blanket 21*a*, the squeegee 22*b* of the rotary screen 22 tends to fall or drop into the groove 21*c* or duct together with the hollow roller 22*c*. To prevent the fall of the squeegee 22*b* and the hollow roller 22*c* of the rotary screen 22 into the groove 21*c* of the blanket 21*a* of the rubber roller 21, a peripheral support portion 21*d* in the form of raised annular segments or rims for constantly supporting both end sides of the squeegee 22*b* via the hollow roller 22*c* away from the roller 21 is formed on each of both end sides, in the width direction, of the blanket 21*a*.

As shown in FIG. 1, a wiping roller 23 is contacted with the intaglio plate on the plate cylinder 15. The wiping roller 23 is immersed in a solvent stored in a wiping tank 24.

To the impression cylinder 14, a delivery cylinder 25 is opposed in contact therewith. Between a sprocket coaxial with the delivery cylinder 25 and a sprocket (not shown), a pair of delivery chains 26 are looped. The delivery chains 26 are provided with delivery grippers (not shown) which grip the sheet 100 from the gripper 14*a* of the impression cylinder 14.

The foregoing intaglio printing press is operated in the following manner: The sheets 100 are fed, one by one, from the sheet feeder 10 onto the feedboard 11. The sheet 100 is passed from the swing arm shaft pregripper 12 to the transfer cylinder 13, and then to the gripper 14*a* of the impression cylinder 14, whereupon the sheet 100 is further transported. Separately, each ordinary ink is supplied from inside the ink fountain or reservoir 20 to the chablon roller 17 via the ink fountain roller 19 and the intermediate rollers 18, and further to the ink collecting cylinder 16. Then, the respective ordinary inks are supplied to the intaglio plates of the plate cylinder 15. Simultaneously, special ink is directly supplied, in a constant amount, in a predetermined pattern, from inside the rotary screen 22 to the intaglio plates of the plate cylinder 15 via the rubber roller 21. After surplus inks are removed by the wiping roller 23, the remaining inks on the intaglio plates are transferred onto the sheet 100 accepted by the impression cylinder 14 for printing. The printed sheet 100 is carried and discharged by the delivery chains 26 via the delivery cylinder 25.

As described previously, the rotary screen 22 directly feeds special ink in a constant amount, at the same time, in a predetermined pattern. Thus, special ink with poor transfer characteristics can be supplied efficiently to the intaglio plate of the plate cylinder 15. Thus, even when special ink, expensive and poor in transfer characteristics, is used, deterioration of printing quality can be prevented, and increase in the printing cost can be suppressed.

This invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intaglio printing press, comprising:

a plate cylinder having an intaglio plate mounted on a circumferential surface of the plate cylinder;

an impression cylinder in contact with said plate cylinder;

an ink collecting cylinder in contact with said plate cylinder and having a blanket mounted on a circumferential surface of the ink collecting cylinder;

a first ink supply means in contact with said ink collecting cylinder for supplying ink to said blanket of said ink collecting cylinder;

a second ink supply means in contact with said plate cylinder, for supplying ink to said intaglio plate;

a wiping roller in contact with said plate cylinder, wherein said second ink supply means includes a rotary screen assembly for supplying ink to said_intaglio plate and an intermediate roller member for transferring ink from the rotary screen assembly to said intaglio plate of said plate cylinder, wherein said roller member includes a printing pattern thereon and a groove or duct configuration in an outer peripheral surface portion thereof adjacent the printing pattern in contact with a portion of said ink transferred to said intaglio plate of said plate cylinder from said first ink supply means, and support means located on said roller member for preventing the rotary screen assembly from falling into the groove or duct configuration of the roller member.

2. The intaglio printing press as claimed in claim 1, wherein said rotary screen assembly comprises:

a rotatably supported cylindrical hollow roller having a small hole pattern formed therein;

ink feed means for feeding ink from an ink reservoir to an inner peripheral surface of said hollow roller; and a squeegee located inside said hollow roller for delivering the ink, which has been fed from said reservoir by said ink feed means, through the small hole pattern of said hollow roller to an outer peripheral surface thereof.

3. The intaglio printing press as claimed in claim 1, wherein the ink supplied by said second ink supply means is OVI (Optical Variable Ink).

4. The intaglio printing press as claimed in claim 1 wherein said support means comprises raised annular end segments on the roller member.

5. The intaglio printing press as claimed in claim 1 wherein said support means comprises a pair of raised rim portions located at the outer end regions of the member roller.

6. An intaglio printing press, comprising:

a plate cylinder having an intaglio plate mounted on a circumferential surface of the plate cylinder;

an impression cylinder in contact with said plate cylinder;

an ink collecting cylinder in contact with said plate cylinder and having a blanket mounted on a circumferential surface of the ink collecting cylinder;

a first ink supply means in contact with said ink collecting cylinder for supplying ink to said blanket of said ink collecting cylinder;

a second ink supply means in contact with said plate cylinder for supplying ink to said intaglio plate;

a wiping roller in contact with said plate cylinder, wherein said second ink supply means includes a rotary screen and squeegee arrangement, and a grooved roller located between the plate cylinder and the rotary screen for supplying ink to said intaglio plate, said second ink supply means also including means for preventing the rotary screen and squeegee arrangement from falling into a groove formed in the outer periphery surface of said grooved roller.

7. The intaglio printing press as claimed in claim 6, wherein said rotary screen comprises:

a rotatably supported cylindrical hollow roller having a small hole pattern formed therein;

ink feed means for feeding ink from an ink reservoir to an inner peripheral surface of said hollow roller; and a squeegee located inside said hollow roller for delivering said ink which has been fed from said ink reservoir by said ink feed means, through the small hole pattern of said hollow roller to an outer peripheral surface thereof.

8. An intaglio printing press, comprising:

a plate cylinder having an intaglio plate mounted on a circumferential surface of the plate cylinder;

an impression cylinder in contact with said plate cylinder;

an ink collecting cylinder in contact with said plate cylinder and having a blanket mounted on a circumferential surface of the ink collecting cylinder;

a first ink supply means in contact with said ink collecting cylinder for supplying ink to said blanket of said ink collecting cylinder;

a second ink supply means in contact with said plate cylinder and including a rotary screen assembly for supplying ink to said intaglio plate;

a wiping roller in contact with said plate cylinder; and means for preventing the rotary screen assembly from falling onto the plate cylinder while supplying ink to said intaglio plate.

9. An intaglio printing press as claimed in claim 8 wherein the rotary screen assembly includes an internally located squeegee for delivering ink from an ink reservoir to an outer peripheral surface of the screen assembly.

* * * * *